US005119887A

United States Patent [19]

Rosa

[11] Patent Number: 5,119,887

[45] Date of Patent: Jun. 9, 1992

[54] OIL WELL HEAD FIRE CAP

[76] Inventor: Robert J. Rosa, P.O. Box 9023, Incline Village, Nev. 89450

[21] Appl. No.: 716,921

[22] Filed: Jun. 18, 1991

[51] Int. Cl.[5] ..... E21B 33/037

[52] U.S. Cl. ..... 166/96; 166/97; 169/69

[58] Field of Search ..... 166/77.5, 86, 94, 96, 166/97; 169/69

[56] References Cited

U.S. PATENT DOCUMENTS

| | | | |
|---|---|---|---|
| 1,520,288 | 12/1924 | Featherstone | 169/49 |
| 1,830,061 | 11/1931 | Howe | 169/69 X |
| 4,323,118 | 4/1982 | Bergmann | 166/97 X |
| 4,433,733 | 2/1984 | Cunningham | 169/69 X |
| 4,562,888 | 1/1986 | Collet | 166/97 |

*Primary Examiner*—William P. Neuder

[57] ABSTRACT

An Oil Well Head Fire Cap is a self-locking and sealing adapter coupling that, when lowered onto an uncontrolled well head fire, will connect a new well head valve to a burning oil well casing. When the valve is closed, the fire is extinguished by stopping the flow of gushing fuel. The Coned shape of the device will allow it to center itself and, when forced down with a cement anchor block, will compress an inner casing into a tapered sleeve until it reaches the seal material and seats. A plurality of spring-engaged sprags, set in recesses, with upwardly pointed horizontal teeth, will roll back, out of the way, as the coupling is lowered on the outer, or surface, casing. As the anchor block is removed, the coupling is lifted by the downhole pressure. The spring-engaged sprags will bite into the outer casing forcing them to roll out tighter against the outer casing, making a firmer grip or deeper "bite". The embodiment of the coupling/Fire Cap will be of corresponding shape to the removable cement anchor block.

3 Claims, 6 Drawing Sheets

OIL WELL HEAD FIRE CAP

BACKGROUND

1. Field of Invention

The present invention relates to a self-locking coupling that is attached to a burning oil well head, specifically to cap and control the well head by placing a new valve on the current uncontrolled well head.

2. Description of Prior Art

In the oil industry, one of the most common ways to control an oil well fire is by the use of high explosives. This method will explode the air around the well head which smothers the fire.

Another method injects chemicals ($co_2$) into the well pipe and the flow of oil coming from the well pipe. This will eliminate the fire also.

A third practice involves forcing mud, by using high pressure, through a nozzle and down the well pipe. This forces the oil back down the well which will, temporarily stop the flow of oil, putting out the fire.

All of the current methods involve danger and strong risk factors. Some of the disadvantages include the use of high explosives, chemicals, large amounts of water as well as the crew needed to apply the methods. The prior art will attack and control the fire itself, most of the time, but the fuel needed to feed the fire is still apparent, leaving the strong possibility that the fire will be reignited. The fuel is still uncontrolled, therefore, the ideal method would involve eliminating the source of the fire by turning off the flow of oil altogether without destroying the oil well head so the existing well may be used again, for production, immediately. None of the above methods give consideration to the spouting and uncontrolled flow of oil. Both problems should be solved while using the same method. Also, the agents necessary to insure the crews ultimate safety are quite costly and a risk.

OBJECTS AND ADVANTAGES of AN OIL WELL HEAD FIRE CAP

Accordingly, besides the objects and advantages of the need to currently control the planets current situation with the uncontrolled oil well fires, several objects and advantages of the current invention are:

(a) to provide a method to attach a new valve to an oil well head, which is on fire, in order to put out the fire while containing the oil and eliminating the source of the fire.

(b) to eliminate the need for a crew to have to work near to the burning oil well by using a self-locking coupling which is operated from a safe and remote distance from the uncontrolled fire.

(c) to provide a method of capping and controlling an oil well fire without the use of high explosives, chemicals or large amounts of water.

(d) to provide the means to put out the uncontrolled fire while controlling the flow of oil, in one process.

(e) to eliminate the need for extreme costs by cutting down the need for large amounts of equipment and personnel as well as the use of natural resources such as water and the means to provide it.

(f) to provide a quick and productive way to put out an oil well fire allowing production of the existing oil by the following day.

Furthermore, this method can be put to use with little production and cost. The invention can be virtually ready immediately to begin putting out the current well fires and can finish the task in one quarter the time of the current methods.

DESCRIPTION OF THE INVENTION

The present invention provides a new coupling device for connecting a new well head valve to the casing of an oil or gas well for the purpose of stopping the flow of oil or gas from the well, which would be feeding the fire on a "Wild Well".

Figure 1:
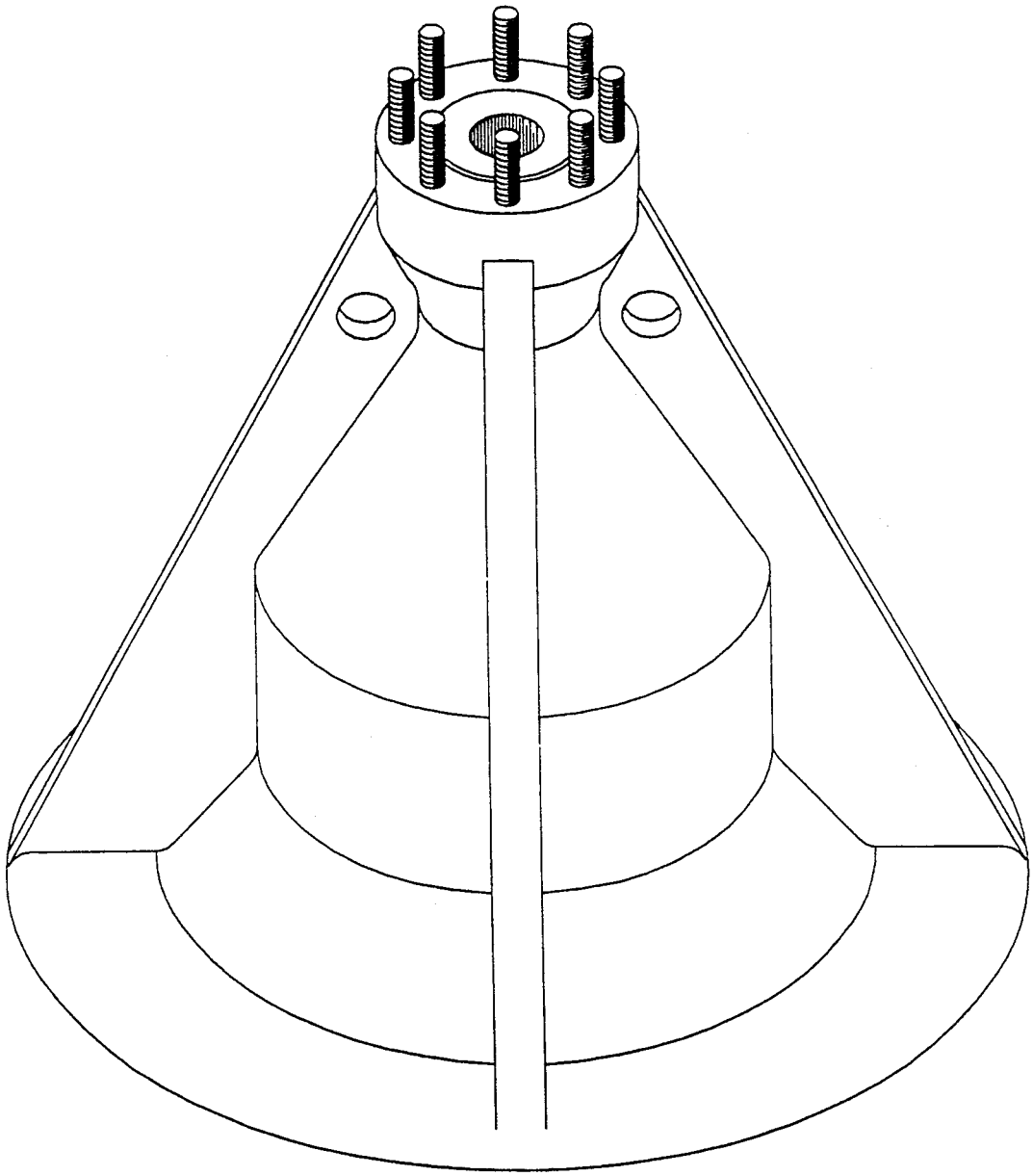
FIG. 1 is an overall view of the Fire Cap showing the bolt pattern for the attachment of a new Valve and the overall conical shape.
Figure 7A:
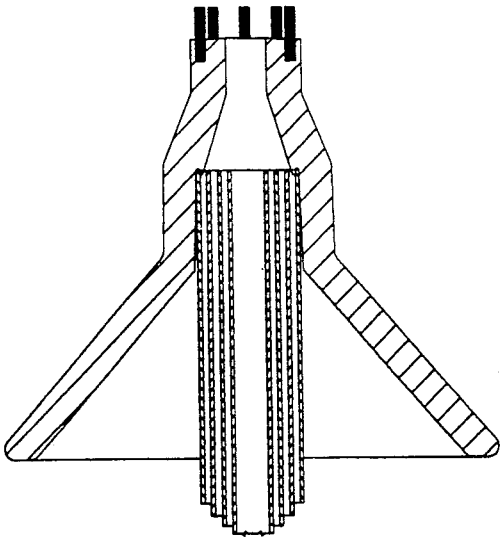
FIGS. 7A & 7B show an alternate possible embodiment compressing the outer casing into the tapered sleeve. This embodiment is shaped in such a way as to be held onto the casings by a cement anchor cone (not shown).
Figure 7B:
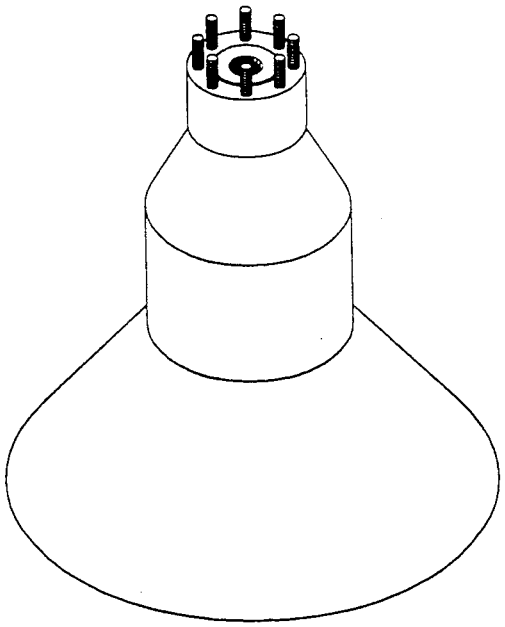

The shape of the Fire Cap depicted in FIG. 1, FIG. 7 and FIG. 7 show a conical form to allow the support of the steel-skirted cement anchor cone (not shown). This anchor cone is removable and reuseable and used for the purpose of compressing the inner tubing or any selected casing into the tapered sleeve 20 (FIG. 2) when lowered onto the casings. When the compressed casing reaches the lip, at the top portion of the inner wall 50 (FIG. 2), it will compact into the seal material 60 (FIG. 2) creating a complete seal.

The rolling sprags 40 (FIG. 2) will roll back, out of the way of the outer casing when the Fire Cap is lowered over the selected casing.

Figure 2:
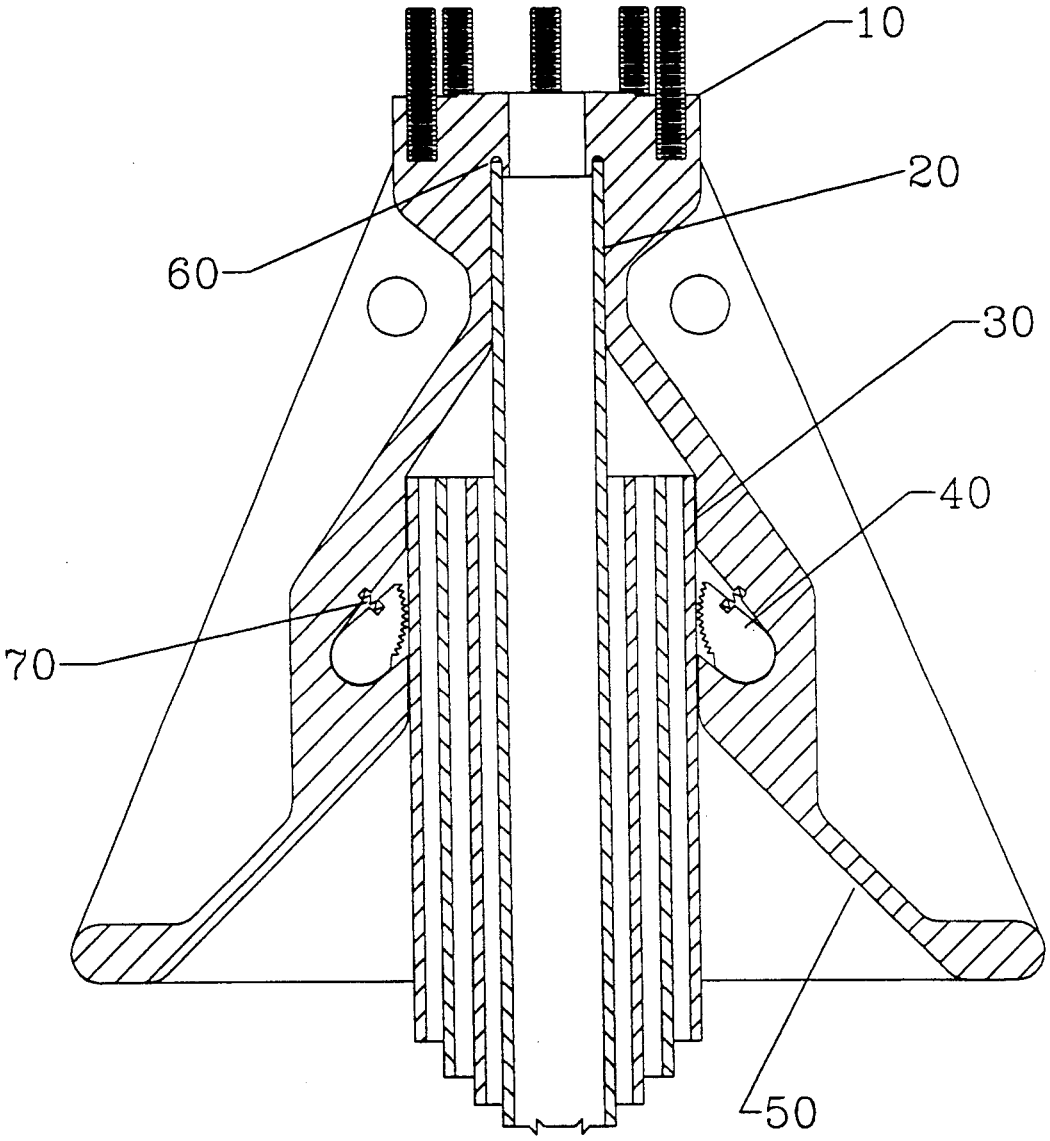
FIG. 2 shows a cutaway view of the Fire Cap lowered over the well casings with the rolling sprags resting against the outer casing and the inner casing compressed into the tapered sleeve.
Figure 3:
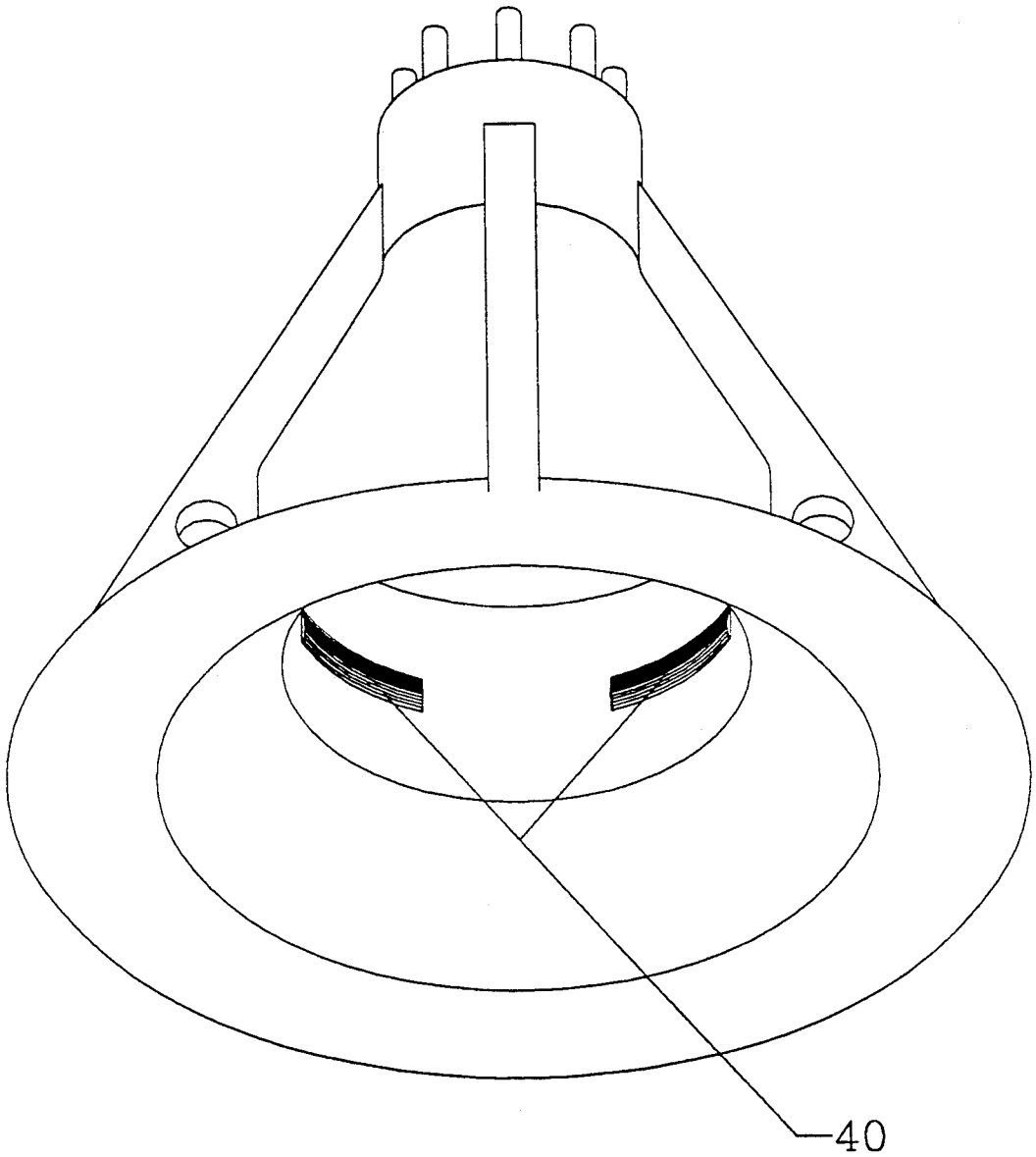
FIG. 3 shows the rolling sprags in their recesses, in the Fire Cap.
Figure 4A:
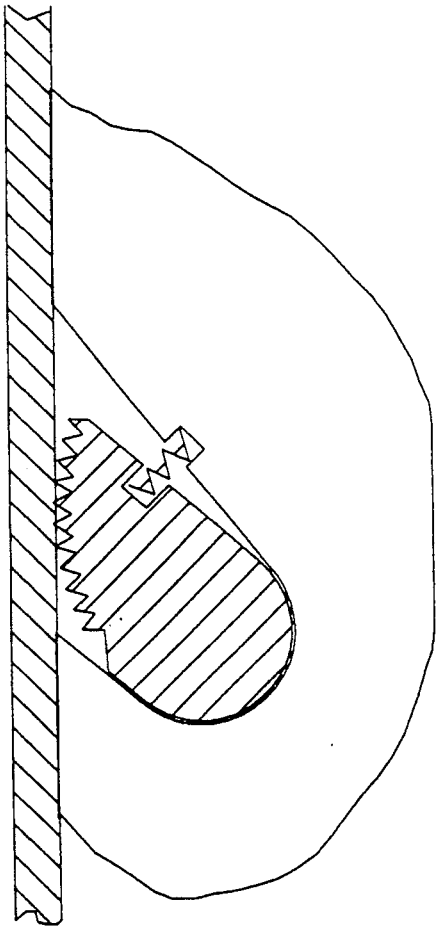
FIG. 4A shows a cutaway view of a sprag in it's recess.
Figure 4B:
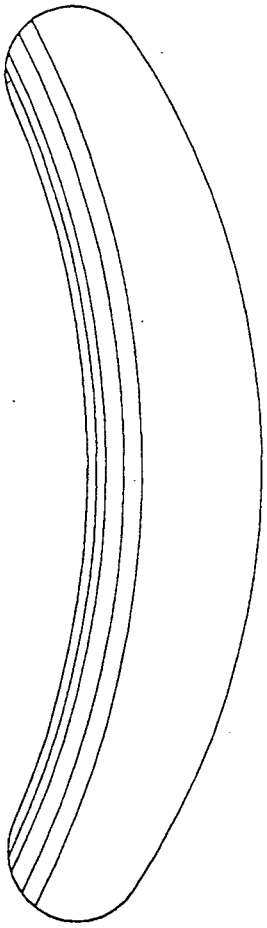

At this point, the new valve (not shown) is closed by means of remote control, stopping the flow of oil from the well. This new valve is connected to the Fire Cap by the intragal flange 10 (FIG. 2). The intragal flange will transmit the upward force from the well to the Fire Cap which will cause the Fire cap to lift. The lifting force will cause the rolling sprags 40 (FIG. 2) to roll inward against the chose casing making a firmer and deeper "bite" (due to the sprags "cam-shape") to hold the Fire Cap in place. The rolling sprags should not be limited to one row as depicted at 40 (FIG. 3).

If, for any reason, the Fire Cap sprags should fail to retain the Cap on the casing, the anchor cone may be left in place and the seal will be maintained by it's weight.

Figure 5:
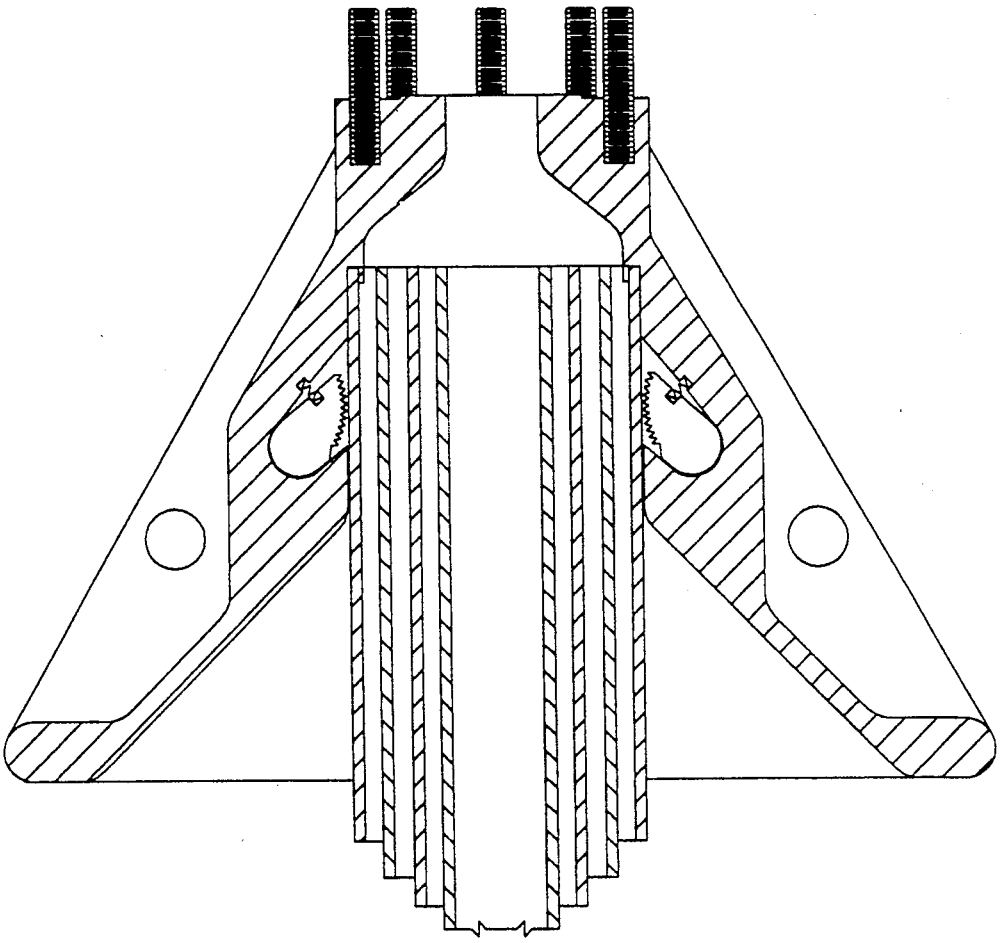
FIG. 5 is an alternate possible embodiment showing the tapered sleeve compressing the outer casing.
Figure 6A:
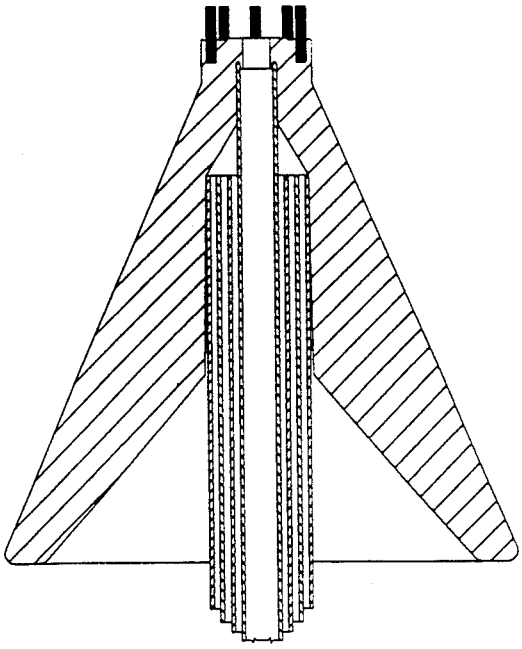
FIGS. 6A & 6B show an alternate possible embodiment, cutaway, showing the inner casing compressed in the tapered sleeve, held in place by the weight of the device.
Figure 6B:
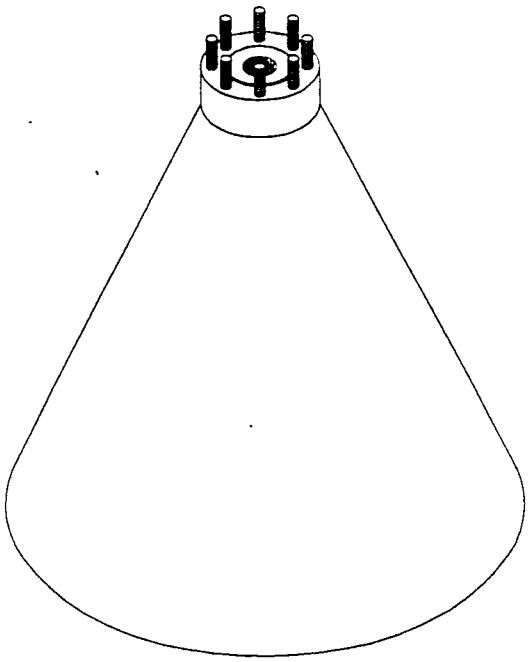

The embodiment of the Fire Cap should included, but not be limited to the alternate drawings at FIG. 5, FIG. 6 and FIG. 7.

I claim:

1. An oil well head fire cap comprising a substantially cylindrical body having a central opening extending the length thereof with said opening having multiple diameters and a tapering wall, said tapering wall having a lip at the top of said wall, sealing means on the lip, the casing is compressed into the tapered wall, whereby final sealing is accomplished upon the casing compacting said sealing means.

2. The fire cap of claim 1 further comprising means for attaching the head to the casing, said attachment means including a plurality of curved, rolling sprags set in recesses.

3. The fire cap of claim 1 including means to attach a new well head valve to said fire cap by means of an integral flange.

* * * * *